US009555318B2

(12) United States Patent
Shigeta

(10) Patent No.: US 9,555,318 B2
(45) **Date of Patent: *Jan. 31, 2017**

(54) PACKING BOX FOR SHUFFLED PLAYING CARDS

(71) Applicant: ANGEL PLAYING CARDS CO., LTD, Osaka (JP)

(72) Inventor: Yasushi Shigeta, Kyoto (JP)

(73) Assignee: Angel Playing Cards Co., Ltd., Shiga (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/419,612

(22) PCT Filed: Dec. 17, 2012

(86) PCT No.: PCT/JP2012/008036

§ 371 (c)(1),
(2) Date: Feb. 4, 2015

(87) PCT Pub. No.: WO2014/024239

PCT Pub. Date: Feb. 13, 2014

(65) Prior Publication Data

US 2015/0174471 A1 Jun. 25, 2015

(30) Foreign Application Priority Data

Aug. 5, 2012 (JP) ..... 2012-182741

(51) Int. Cl.
*A63F 1/14* (2006.01)
*A63F 1/06* (2006.01)
(Continued)

(52) U.S. Cl.
CPC ..... *A63F 1/062* (2013.01); *A63F 1/14* (2013.01); *A63F 1/10* (2013.01); *A63F 1/12* (2013.01);
(Continued)

(58) Field of Classification Search
CPC ..... A63F 1/062; A63F 2250/58; A63F 1/10; A63F 1/12; A63F 1/14; A63F 2009/2489; A63F 2009/242; B65D 75/54; B65D 75/58; B65D 75/5805; B65D 75/5827; B65D 75/5833; B65D 75/5838; B65D 75/5844
(Continued)

(56) References Cited

U.S. PATENT DOCUMENTS 945,868 A * 1/1910 Sanguinette ..... B65D 5/5286 206/315.1
1,404,945 A * 1/1922 Epstein ..... A63F 1/06 206/232
(Continued)

FOREIGN PATENT DOCUMENTS

CN 2521159 Y 11/2002
CN 201231942 Y 5/2009
(Continued)

OTHER PUBLICATIONS

New Zealand Patent Application No. 704614, First Examination Report mailed Aug. 21, 2015.
(Continued)

*Primary Examiner* — Benjamin Layno
(74) *Attorney, Agent, or Firm* — Chadbourne & Parke LLP

(57) ABSTRACT

A packing box of shuffled playing cards has, in an assembled state, a shape of a rectangular parallelepiped with six faces, namely, a front face, a rear face, a left side face, a right side face, a top face and a bottom face so as to encase the shuffled playing cards. The packing box includes zippers provided in locations at a predetermined interval, each of which includes zipper-shaped cut lines arranged in parallel with a longitudinal direction of the rectangular parallelepiped shape, and has a central band in the central portion defined by the
(Continued)

zippers provided in the two locations. A configuration is achieved in which by removing the two zippers along the cut lines formed by zipper lines or a straight slit, the left and right side faces of the packing box are removed such that the side faces of the shuffled playing cards 1 would be exposed.

9 Claims, 7 Drawing Sheets

(51) Int. Cl.

| | |
|---|---|
| *B65D 75/58* | (2006.01) |
| *B65D 75/54* | (2006.01) |
| *A63F 1/10* | (2006.01) |
| *A63F 1/12* | (2006.01) |
| *A63F 9/24* | (2006.01) |

(52) U.S. Cl.
CPC .. *A63F 2009/242* (2013.01); *A63F 2009/2489* (2013.01); *A63F 2250/58* (2013.01); *B65D 75/54* (2013.01); *B65D 75/58* (2013.01); *B65D 75/5805* (2013.01); *B65D 75/5827* (2013.01); *B65D 75/5833* (2013.01); *B65D 75/5838* (2013.01); *B65D 75/5844* (2013.01)

(58) Field of Classification Search
USPC .... 273/148 A, 148 R, 149 R; 206/315.1, 39, 206/451, 459.5, 526; 229/200, 203, 229/240–242
See application file for complete search history.

(56) References Cited

U.S. PATENT DOCUMENTS

| | | | | | |
|---|---|---|---|---|---|
| 1,848,764 | A * | 3/1932 | Beyer | B65D 5/4204 | 206/39 |
| 2,430,707 | A * | 11/1947 | Cahn | A63F 1/06 | 206/315.1 |
| 2,447,279 | A * | 8/1948 | Rosenfeld | A63F 1/06 | 206/315.1 |
| 2,533,577 | A * | 12/1950 | Godfrey | A63F 1/06 | 206/315.1 |
| 2,577,007 | A * | 12/1951 | Dubilier | A63F 1/06 | 206/315.1 |
| 3,071,244 | A * | 1/1963 | Doran | B65D 5/5495 | 206/273 |
| 3,388,853 | A * | 6/1968 | Matich, Jr. | G03G 15/0884 | 206/222 |
| 3,858,717 | A | 1/1975 | Peters | | |
| 4,111,297 | A | 9/1978 | Paulin | | |
| 2003/0024841 | A1 | 2/2003 | Murphy | | |
| 2006/0191426 | A1 | 8/2006 | Timmerman et al. | | |
| 2007/0120321 | A1 * | 5/2007 | Fruchtman | A63F 1/06 | 273/148 A |
| 2010/0155292 | A1 | 6/2010 | Fell | | |
| 2010/0327525 | A1 | 12/2010 | Shigeta | | |
| 2011/0130185 | A1 | 6/2011 | Walker | | |

FOREIGN PATENT DOCUMENTS

| | | | |
|---|---|---|---|
| DE | 202007003422 | U1 | 8/2007 |
| JP | H05051079 | A | 3/1993 |
| JP | 2002172013 | A | 6/2002 |
| JP | 2002284151 | A | 10/2002 |
| JP | 2004035095 | A | 2/2004 |
| JP | 2006335384 | A | 12/2006 |
| JP | 2009012820 | | 1/2009 |
| JP | 2011024603 | A | 2/2011 |
| JP | 3167277 | U | 4/2011 |
| WO | 0071438 | A1 | 11/2000 |
| WO | 2007062701 | A1 | 6/2007 |
| WO | 2009069708 | A1 | 6/2009 |

OTHER PUBLICATIONS

Australian Patent Application No. 2012261673, Examination Report No. 1 mailed Jul. 4, 2013.
Australian Patent Application No. 2012261673, Notice of Acceptance mailed Sep. 10, 2014.
International Application No. PCT/JP2012/008036, Written Opinion and International Search Report mailed Feb. 5, 2013.
Chinese Patent Application No. 201210585739.4, First Office Action mailed Nov. 26, 2015.
Korean Patent Application No. 10-2015-7004998, Office Action mailed Jun. 16, 2016.
IP Australia Patent Examination Report, Australian Patent Application No. 2012387314; issued Sep. 17, 2016.

* cited by examiner

PACKING BOX FOR SHUFFLED PLAYING CARDS

CROSS REFERENCE TO RELATED APPLICATIONS

This application is a National Phase application under 35 U.S.C. §371 of PCT Application PCT/JP2012/008036, filed Dec. 17, 2012, which application claims priority benefit to Japanese Application Serial No. 2012-182741, filed Aug. 5, 2012, which applications are hereby incorporated by reference.

TECHNICAL FIELD

The present invention relates to playing cards used in playing games, and particularly, to shuffled playing cards packed as an individual pack after being shuffled in a random manner, a packing box for packing an individual set of playing cards and a method of housing the shuffled playing cards in a card shooter or the like.

BACKGROUND ART

In poker, baccarat, bridge, blackjack, and other playing games, a dealer sets one or more decks of playing cards in a card shooter or the like, and deals cards to game players by shooting the cards one by one out of the card shooter or the like. In so doing, to ensure fairness of the games, the cards need to be dealt at random. Therefore, a game host has to sufficiently shuffle the playing cards randomly in order to ensure a random order of arrangement of the playing cards before the playing cards are set in the card shooter.

It should be noted that a conventional card shuffling device for shuffling cards is disclosed in, for example, Patent Literature 1.

The shuffled playing cards used in various playing games such as poker, baccarat, bridge or blackjack include, ordinary, 416 cards if eight decks of cards are used. Eight decks of playing cards have 416 cards, and the height thereof is approximately 125 mm. Therefore, when the dealer tries to set such 416 playing cards in a card shooter or the like at one time, it may be impossible to house the cards neatly since they get misaligned, which is a problem and hampers the efficient operation of the games. There is also a problem of possible cheating such as the insertion/removal or switching of cards when the cards are housed in a card shooter.

CITATION LIST

Patent Literature

Patent Literature 1: WO 2009/069708

SUMMARY OF INVENTION

Problems to be Solved by the Invention

The present invention has been made in view of the above problems, and aims to provide a packing box of playing cards, shuffled playing cards and a method of housing the shuffled playing cards in a card shooter or the like with which the game host can readily set playing cards in a card shooter or the like prior to a game, and that can eliminate the possibility of cheating.

Means for Solving the Problems

To achieve the above object, the present invention provides a packing box of playing cards that has, in an assembled state, a shape of a rectangular parallelepiped with six faces that are front and rear faces, right and left side faces, and top and bottom faces, and encases the playing cards, the packing box including zippers or cutoff units in two locations at a predetermined interval, the zippers or the cutoff units including cut lines in parallel with a longitudinal direction of the rectangular parallelepiped shape, and a central band in a central portion defined by the zippers or the cutoff units provided in the two locations, wherein the right and left side faces of the packing box can be removed by removing the zippers or the cutoff units such that side faces of the playing cards are exposed.

To achieve the above object, the present invention provides shuffled playing cards that are housed in a packing box and encased therein in a shuffled state, and sealed, the shuffled playing cards containing a number of cards that can form a predetermined number of decks, the packing box being a packing box that has a shape of a rectangular parallelepiped with six faces that are front and rear faces, right and left side faces, and top and bottom faces, and that has zippers or cutoff units in two locations at a predetermined interval, the zippers or the cutoff units including zipper lines or cut lines in parallel with a longitudinal direction of the rectangular parallelepiped shape, and a central band provided in a portion defined by the zippers or the cutoff units provided in the two locations, wherein the right and left side faces of the packing box can be removed by removing the zippers or the cutoff units along the zipper lines or the cut lines such that side faces of the playing cards are exposed.

To achieve the above object, the present invention provides a method of housing the shuffled playing cards in a card housing portion of a shooter used in playing games wherein playing cards containing a number of cards that can form a predetermined number of decks are housed in a packing box and encased therein in a shuffled state, and sealed, with the packing box being a packing box that has a shape of a rectangular parallelepiped with six faces that are front and rear faces, right and left side faces, and top and bottom faces, and that has zippers or cutoff units in two locations at a predetermined interval, the zippers or the cutoff units including zipper lines or cut lines in parallel with a longitudinal direction of the rectangular parallelepiped shape, and a central band provided in a portion defined by the zippers or the cutoff units provided in the two locations, wherein the right and left side faces of the packing box can be removed by removing the zippers or the cutoff units such that side faces of the playing cards are exposed, comprising a first side face exposure step; removing one of the zippers or the cutoff units of the packing box wherein the shuffled playing cards are housed and thereby exposing one side face of the shuffled playing cards within the packing box by detaching right or left side of the packing box, a second side face exposure step: removing the other of the zippers or the cutoff units of the packing box and exposing the both side faces of the shuffled playing cards within the packing box by detaching both sides of the packing box thereby achieving a state in which the shuffled playing cards are wrapped only with the central band, a shuffled playing cards lifting step; holding the corner of the central band to lift the shuffled playing cards together, a housing step; housing the shuffled playing cards and the central band in the card housing portion of the shooter, a housing completion step; tearing the central band to remove the central band thereby completing the housing with only the shuffled playing cards left in the card housing portion.

With the present invention, it is possible to achieve an easier handling of a predetermined number of decks of shuffled playing cards to be used in card games so that the cards can be set to a shooter in a safe and reliable manner, thereby improving the operability of games at casinos, reducing the operation cost and improving safety.

As described below, the present invention includes other aspects. Thus, disclosure of the invention is intended to provide a part of aspects of the present invention, and not intended to limit the scope of the invention described and claimed herein.

DESCRIPTION OF EMBODIMENTS

Now, the present invention will be described in detail. The detailed description below and the accompanying drawings do not limit the invention.

Figure 1A:
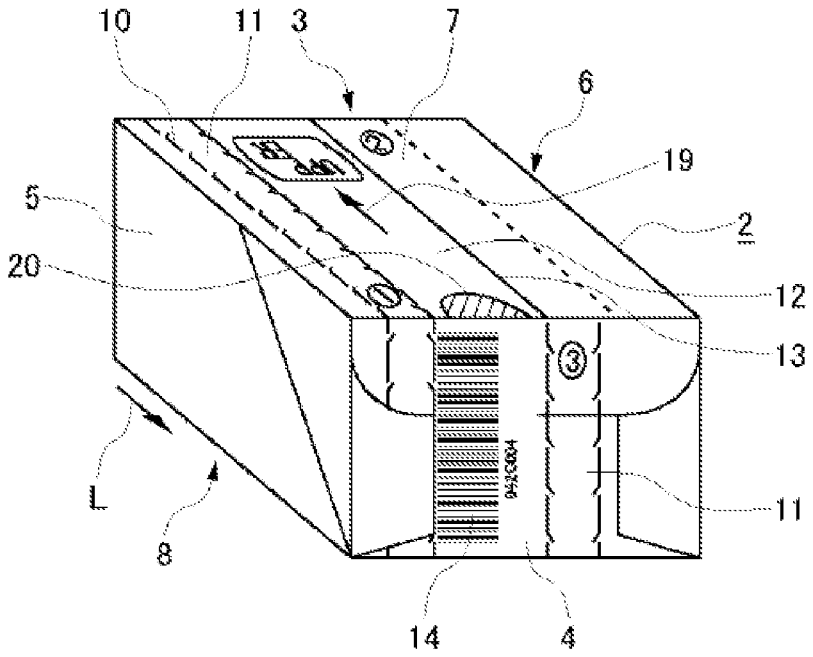
FIG. 1(*a*) is a perspective view of a packing box packing shuffled playing cards according to Embodiment 1 of the present invention, and FIG. 1(*b*) is a perspective view showing a state in which the packing box packing the shuffled playing cards is partially broken to show a portion of the cards.
Figure 1B:
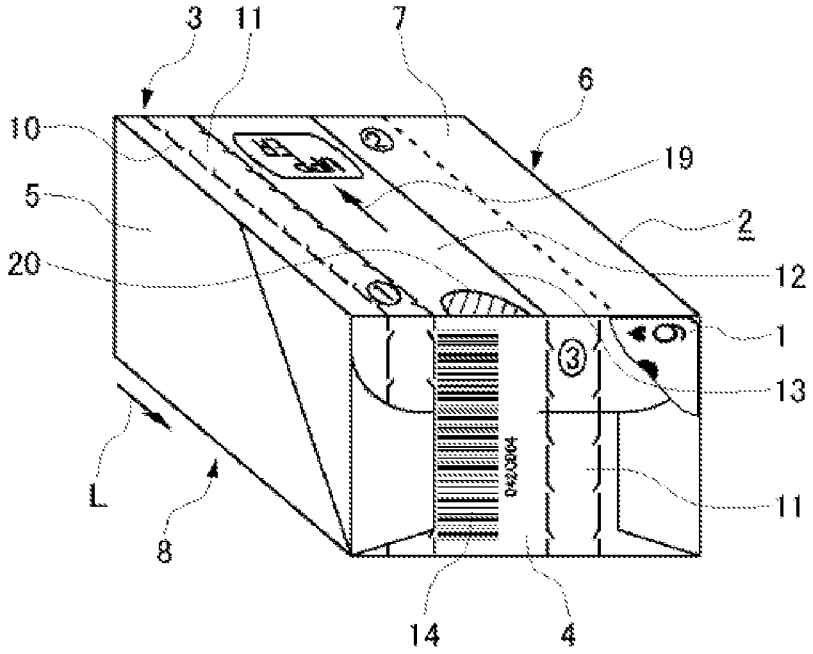

Embodiment 1 of the present invention will be described with reference to the attached drawings. FIGS. 1(*a*) and 1(*b*) are perspective views each illustrating a packing box of Embodiment 1 packing shuffled playing cards. A packing box 2 of shuffled playing cards 1 has the shape of a rectangular parallelepiped with six faces, namely, a front face 3, a rear face 4, a left side face 5, a right side face 6, a top face 7 and a bottom face 8 so as to encase the shuffled playing cards 1 in an assembled state. The packing box 2 includes zippers 11 provided in two locations at a predetermined interval, each of which includes zipper-shaped cut lines 10 arranged in parallel with a longitudinal direction (an arrow L) of the rectangular parallelepiped shape, and has a central band 12 in the central portion defined by the zippers 11 provided in the two locations. The central band 12 is colored so as to be readily distinguishable from the other portions. (The coloring is omitted in FIG. 1-FIG. 4) As described in detail later, a configuration is achieved in which by removing the two zippers 11 along the cut lines 10 formed by zipper lines or a straight slit 13, the left and right side faces 5 and 6 of the packing box 2 are removed such that the side faces of the shuffled playing cards 1 would be exposed. Note that it is possible to configure the zipper 11 as a cutoff unit to enable a cut along the cut line 10 with a thread or the like, as a variation.

Figure 2:
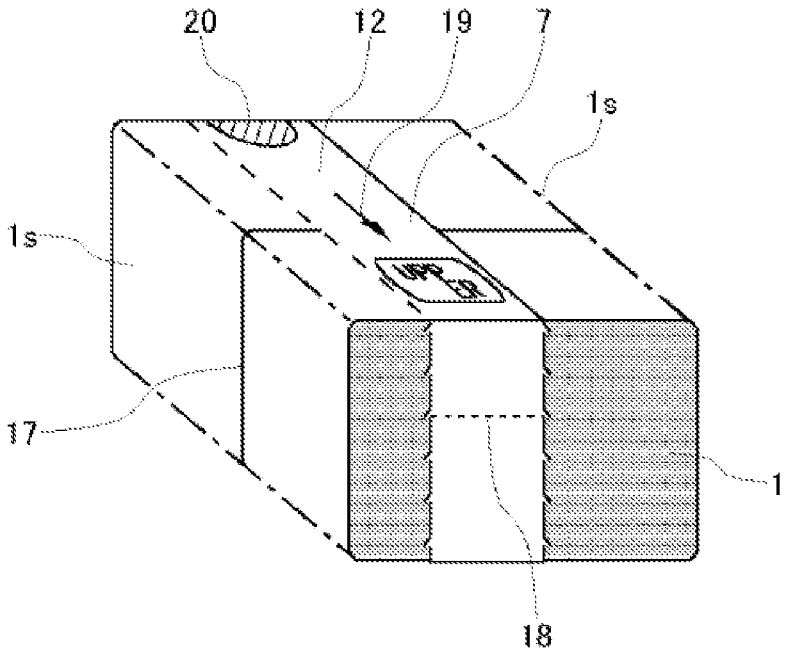
FIG. 2 is a perspective view showing a state in which the side faces of the shuffled playing cards of Embodiment 1 of the present invention are exposed.
Figure 3:
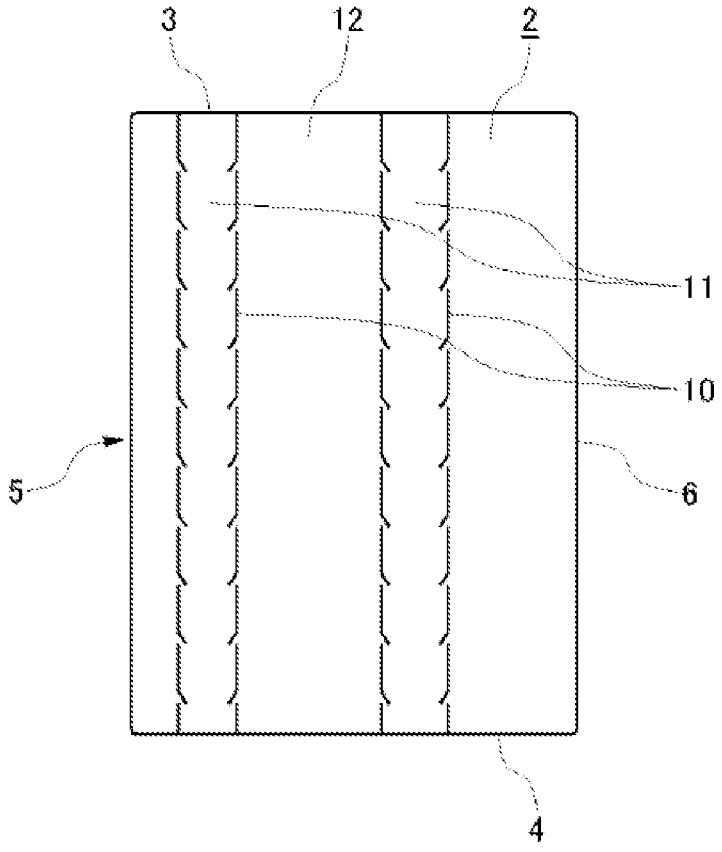
FIG. 3 is a bottom view of a packing box of the shuffled playing cards.

FIG. 2 is a perspective view showing a state in which side faces 1*s* of the shuffled playing cards 1 are exposed. The shuffled playing cards 1 are made up of a predetermined number of decks, and for example, in the case of eight decks of shuffled playing cards 1, there are 416 cards. The shuffled playing cards 1 are shuffled by a conventional card shuffling device in advance in order for them to be arranged in a random order, housed in the packing box 2 that encases the shuffled playing cards 1, sealed with a sealing material or a shrink packaging material, and then supplied to casinos or the like. Note that FIG. 1 shows a state in which the packing boxes 2 housing the shuffled playing cards 1 each have attached thereon a bar code 14 (also serving as a seal), the bar codes 14 having mutually different ID codes (identification codes). The sets of shuffled playing cards 1 have mutually different card arrangement orders due to shuffling, and thus, each set is unique. Therefore, in order to identify each set, an ID code is used in the form of a bar code 14 or a QR (quick response) code.

Figure 5:
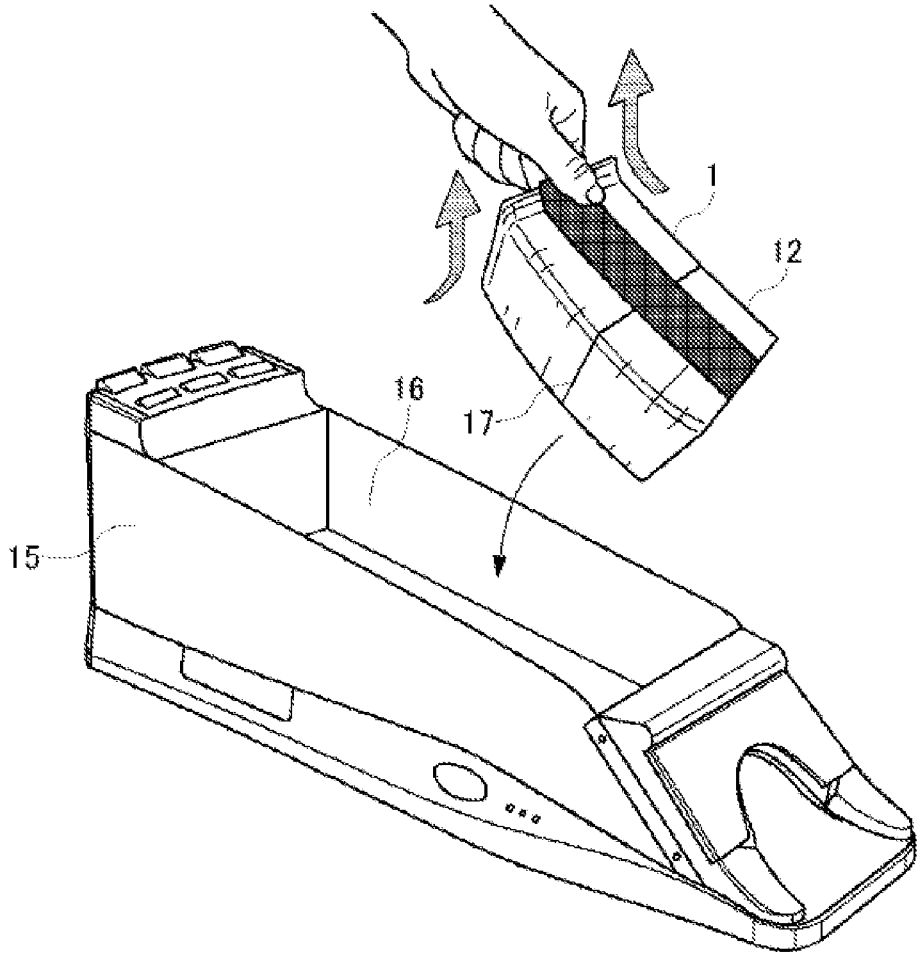
FIG. 5 is a schematic diagram showing a state in which the shuffled playing cards are housed in a shooter.

Next, with reference to FIGS. 5 and 6, a method of housing the shuffled playing cards 1 in a shooter 15 that is used in a casino or the like will be described. When the shuffled playing cards 1 are housed in the card shooter 15 to be used in a casino or the like, the zippers 11 are removed along the cut lines 10 such as zipper lines and then the left and right side faces 5 and 6 of the packing box 2 are removed as described above, thereby exposing the side faces 1*s* of the shuffled playing cards 1 as shown in FIGS. 2 and 5. Thereafter, the shuffled playing cards 1 are held at a corner portion of the central band 12 and lifted, and then housed in a card housing portion 16 of the card shooter 15 for playing games, as shown in FIG. 5. The procedure for this will be described in detail below.

Figure 4:
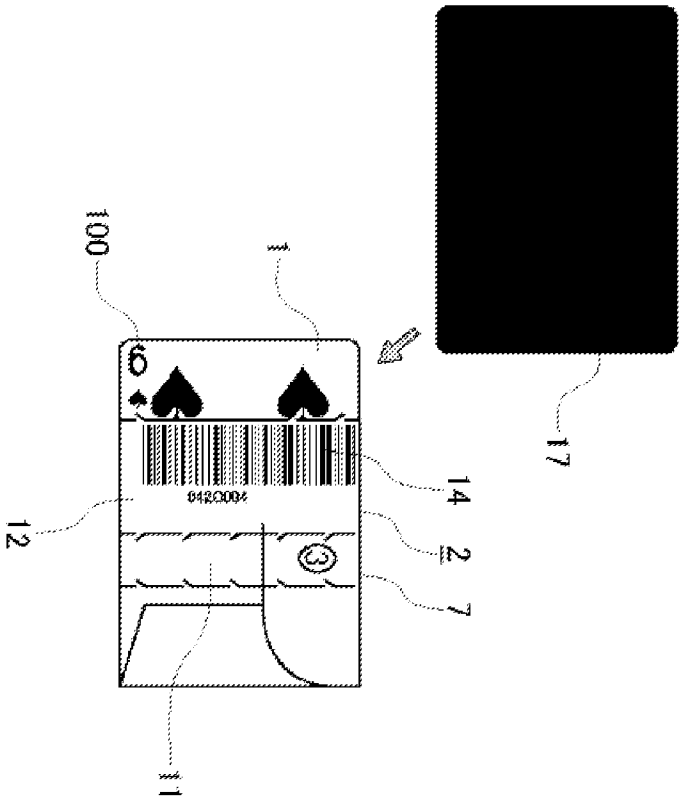
FIG. 4 is a diagram showing a state in which a cut card is inserted in the shuffled playing cards.

In the packing box 2 where the shuffled playing cards 1 are housed, circled numbers 1 to 3 indicating the procedural order for removing the zippers 11 are printed on the zippers 11, as shown in FIG. 1. In accordance with this order, as shown in FIG. 6 (*a*), the portion on the left of a zipper 11 is removed first to remove the left side face 5 of the packing box 2, thereby exposing one side face of the shuffled playing cards 1 within the packing box 2 (a first side face exposure step). This first side face exposure step may further include a card cut step of inserting a cut card 17, which is used at a casino in order to stop the use of the shuffled playing cards 1 in the middle of games after that game as appropriate, into the shuffled playing cards 1. FIG. 4 illustrates that card cut step. Since a player (customer) of the casino is requested to insert the cut card 17 into the shuffled playing cards 1, there may be cheating if an index 100 of a shuffled playing card 1 at the place of insertion is seen when inserting the cut card 17. Therefore, the shuffled playing cards 1 are housed in the packing box 2 in advance such that when the cut card 17 is inserted, the side on which the index of the shuffled playing cards 1 is not printed (the upper left portion of the upper face 7) is on top (see FIG. 4). The procedural order for removing the zippers 11 is indicated with the circled numbers printed on the zippers 11 such that the cut card 17 can be inserted from the left side face 1*s* where the shuffled playing cards 1 are exposed.

Figure 6:
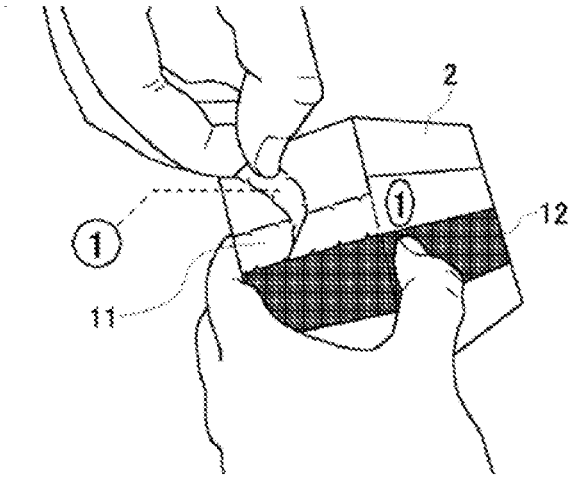
FIGS. 6 (*a*)-6(*d*) are diagrams illustrating a procedure for housing the shuffled playing cards in a shooter.
Figure 6:
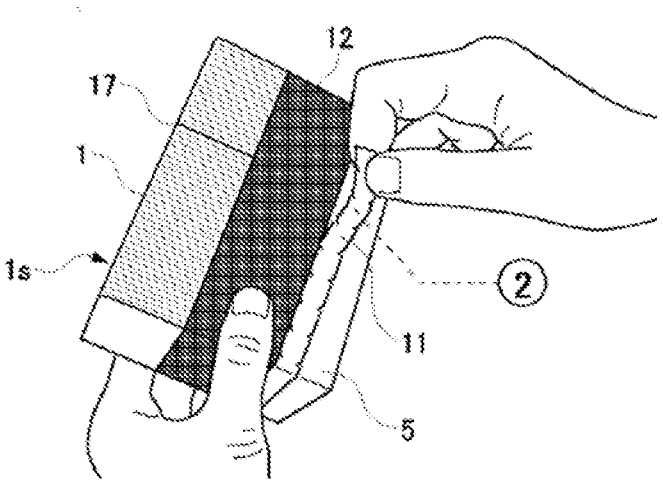
Figure 6:
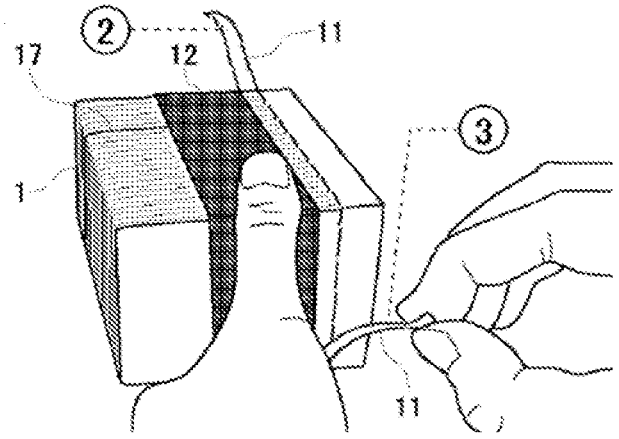
Figure 6:
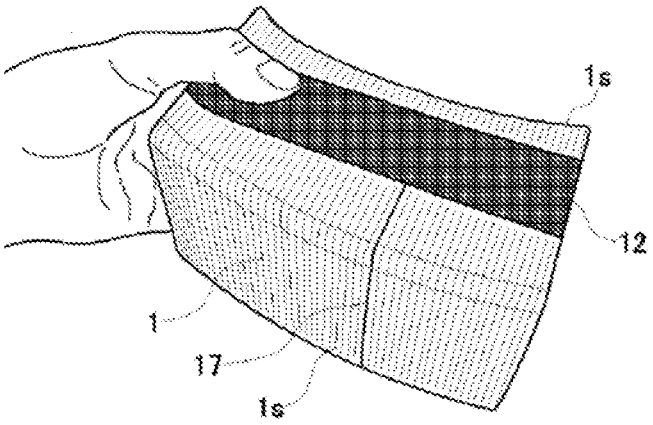

Next, as illustrated in FIGS. 6 (*b*) and 6 (*c*), the other zipper 11 of the packing box 2 on the other side is removed in the order indicated by the circled numbers 2 and 3, and the right side face 6 of the packing box 2 is removed to expose the side faces of the shuffled playing cards 1 within the packing box 2, thereby achieving a state in which the shuffled playing cards 1 are wrapped only with the central band 12 (a second side face exposure step) (see FIG. 2). Next, as illustrated in FIG. 6 (*d*), the rear corner of the central band 12 is held to lift together the shuffled playing cards 1 and the central band 12 (a lifting step). While the shuffled playing cards 1 and the central band 12 are lifted together, the shuffled playing cards 1 and the central band 12 are housed in the card housing portion 16 of the card shooter 15, as shown in FIG. 5 (a housing step). Next, the central band 12 is torn at a portion thereof (e.g., a break line 18) to remove the central band 12 from the card housing portion 16, thereby completing the housing with only the shuffled playing cards 1 left in the card housing portion 16 (a housing completion step). Note that as illustrated in FIG. 6 (*d*), the bar code 14, which is the ID code (such as a bar code) remains in the central band 12. Since the bar code 14, which is the ID code (such as a bar code), remains in the central band 12, it is advantageous to retain the central band 12 without discarding the same, and to dispose of or the like the shuffled playing cards 1 after the use thereof in the game, while putting the shuffled playing cards 1 in a carton bag for disposal, with the corresponding central band 12 including the bar code 14, which is the ID code (such as a bar code), attached thereto, because it is possible to manage the disposal of each set of shuffled playing cards 1 while maintaining the connection with the housing of the cards 1 in the card shooter 15 with a computer or the like, by reading the bar code 14 with a bar code reader (not shown in the drawings).

In Embodiment 1, the top face 7 of the packing box 2 has a marking (UPPER) indicating that it is the top face, and an arrow 19 indicating the orientation of the shuffled playing cards 1 when inserted in the card housing portion 16 (indicating the front/rear of the shuffled playing cards 1), making it possible to house the shuffled playing cards 1 in the card shooter 15 in the proper orientation without fail. Normally, when housed in the card shooter 15, the shuffled playing cards 1 are housed such that their rear faces with the pattern thereon are in front. In addition, a sign (a mark 20) that indicates the place where the central band 12 is to be held and lifted is printed on the central band 12 of the packing box 2, and thus, the place for lifting can be readily found.

Preferred embodiments of the present invention conceivable at the present time have been described. Various modifications may be made to the embodiments, and appended claims encompass all of such modifications within the true spirit and the scope of the present invention.

INDUSTRIAL APPLICABILITY

The shuffled playing cards for use in table games, the packing box of the shuffled playing cards and the method of housing the same in a card shooter of the present invention enable the easy handling of a plurality of decks of shuffled playing cards and the proper housing of the shuffled playing cards in a card shooter, and thus, is useful for table games held in casinos or the like.

REFERENCE SIGNS LIST

1 shuffled playing cards
2 packing box
3 front face
4 rear face
5 left side face
6 right side face
7 top face
8 bottom face
10 cut line
11 zipper
12 central band
14 bar code

The invention claimed is:

1. A package of playing cards, the package having, in an assembled state, a shape of a rectangular parallelepiped with six faces including front and rear faces, right and left side faces, and top and bottom faces, the package comprising:

a cut line, which is formed in a longitudinal direction of the rectangular parallelepiped package, allowing to detach at least one of the left side face and the right side face of the package so as to partially expose the playing cards for inserting a cut card in the playing cards in the package; and a break line, along which allows to be torn a remaining portion, which is a remaining part of the package, when the package is set in a card shooter; and a direction marking indicating the top surface of the package or a correct orientation of the playing cards so that an index surface of the each playing card, on which as index is printed, is not in an upward direction of exposed part while the side face of the package is detached for inserting the cut card.

2. The package according to claim 1, the package further comprising:

a start marking showing a first portion, which is a part of the package should be detached first, for inserting the cut card.

3. The package according to claim 1, wherein only the playing cards are left in the card shooter in such a manner that the remaining portion is torn with the break line and the remaining portion is removed from the card shooter.

4. The package according to claim 1, further comprising a pair of the cut lines, wherein one of the cut lines allows to detach the left side face of the package, wherein another of the cut lines allows to detach the right side face of the package.

5. The package according to claim 1, further comprising a set of shuffled playing cards that are contained in the package in a shuffled state and sealed, the set of shuffled playing cards including one or more decks.

6. The package according to claim 5, wherein the remaining portion of the package has a printed character or a bar code that indicates a different ID for each set of shuffled playing cards.

7. A method of setting shuffled playing cards in a shooter, wherein the shuffled playing cards comprise one or more decks of playing cards shuffled in a random order and contained in a package, the package has a shape of a rectangular parallelepiped with six faces including front and rear faces, right and left side faces, and top and bottom faces, and the package includes a cut line, which is formed in a longitudinal direction of the rectangular parallelepiped and a break line, the method comprising:

detaching at least one of the left side face or the right side faces of the package along the cut line so as to partially expose the playing cards;

inserting a cut card into the shuffled playing cards in the package from the exposed side of the package;

handling the playing cards using a remaining portion, which is a remaining part of the package, to set the playing cards in the shooter; and tearing the break line at the remaining portion of the package in the shooter so as to remove the remaining portion holding the playing cards so that only the playing cards are set in the card shooter.

8. The method of claim 7, prior to the detaching step, further comprising, orienting the package containing the playing cards so that an index surface of the each playing card, on which an index is printed, is not in an upward direction of exposed part while the side face of the package is detached for inserting the cut card.

9. The method of claim 7 wherein the package has a marking showing instructions steps of detaching the package.

* * * * *